US008242063B2

(12) United States Patent
Kawamura et al.

(10) Patent No.: US 8,242,063 B2
(45) Date of Patent: Aug. 14, 2012

(54) LUBRICATING GREASE COMPOSITION

(75) Inventors: Yasushi Kawamura, Tokyo (JP); Toshiki Satou, Tokyo (JP); Keiji Tanaka, Tokyo (JP)

(73) Assignee: Shell Oil Company, Houston, TX (US)

( * ) Notice: Subject to any disclaimer, the term of this patent is extended or adjusted under 35 U.S.C. 154(b) by 1770 days.

(21) Appl. No.: 11/411,487

(22) Filed: Apr. 26, 2006

(65) Prior Publication Data

US 2006/0264338 A1 Nov. 23, 2006

(30) Foreign Application Priority Data

Apr. 28, 2005 (JP) ..... 2005-131694

(51) Int. Cl.
*C10M 169/06* (2006.01)
*C10M 115/04* (2006.01)
*C10M 115/08* (2006.01)

(52) U.S. Cl. ..... 508/165; 508/528; 508/552

(58) Field of Classification Search ..... 508/168, 508/159, 552

See application file for complete search history.

(56) References Cited

U.S. PATENT DOCUMENTS

| | | | | |
|---|---|---|---|---|
| 4,505,832 | A | 3/1985 | Whiteman et al. | 252/42.1 |
| 5,102,565 | A * | 4/1992 | Waynick | 508/164 |
| 2002/0183213 | A1 | 12/2002 | Komiya et al. | 508/485 |
| 2003/0069147 | A1 | 4/2003 | Kawamura et al. | 508/555 |
| 2004/0198617 | A1 * | 10/2004 | Kinoshita et al. | 508/527 |
| 2005/0020456 | A1 * | 1/2005 | Kawamura et al. | 508/364 |
| 2007/0265179 | A1 | 11/2007 | Kinoshita et al. | 508/558 |

FOREIGN PATENT DOCUMENTS

| | | |
|---|---|---|
| JP | 60-31598 | 2/1985 |
| JP | 2-194095 | 7/1990 |
| JP | 8-209167 | 8/1996 |
| JP | 2002-265970 | 9/2002 |
| JP | 2004-83797 | 3/2004 |
| JP | 2004-301268 | 10/2004 |
| JP | 2004-314916 | 11/2004 |
| WO | WO03006590 | 1/2003 |
| WO | WO2004113480 | 12/2004 |

* cited by examiner

*Primary Examiner* — Cephia D Toomer
*Assistant Examiner* — Vishal Vasisth
(74) *Attorney, Agent, or Firm* — Charles W. Stewart

(57) ABSTRACT

A lubricating grease composition comprising base oil and a blended thickener which comprises, as the thickener constituents, (a) one or more urea-type compounds;
(b) one or more fatty acid metal salts; and
(c) at least one type of amide compound selected from the group comprised of aliphatic amides and aliphatic bisamides shown by the general formulae (1) and (2):

$$R_1CONH_2 \quad (1)$$

$$R_1CONHR_2NHCOR_1 \quad (2)$$

wherein $R_1$ denotes a saturated or unsaturated alkyl group having from 15 to 17 carbon atoms and $R_2$ denotes a methylene group or an ethylene group and wherein the blending weight proportions of (a), (b) and (c) are in the ratio of a/(b+c) is in the range of from 0.20 to 10 wherein (1) constituent (a) has a blending weight ratio in the range of from 1 to 10;
(2) constituent (b) has a blending weight ratio in the range of from 0.5 to 2.5; and
(3) constituent (c) has a blending weight ratio in the range of from 0.5 to 2.5.

20 Claims, 1 Drawing Sheet

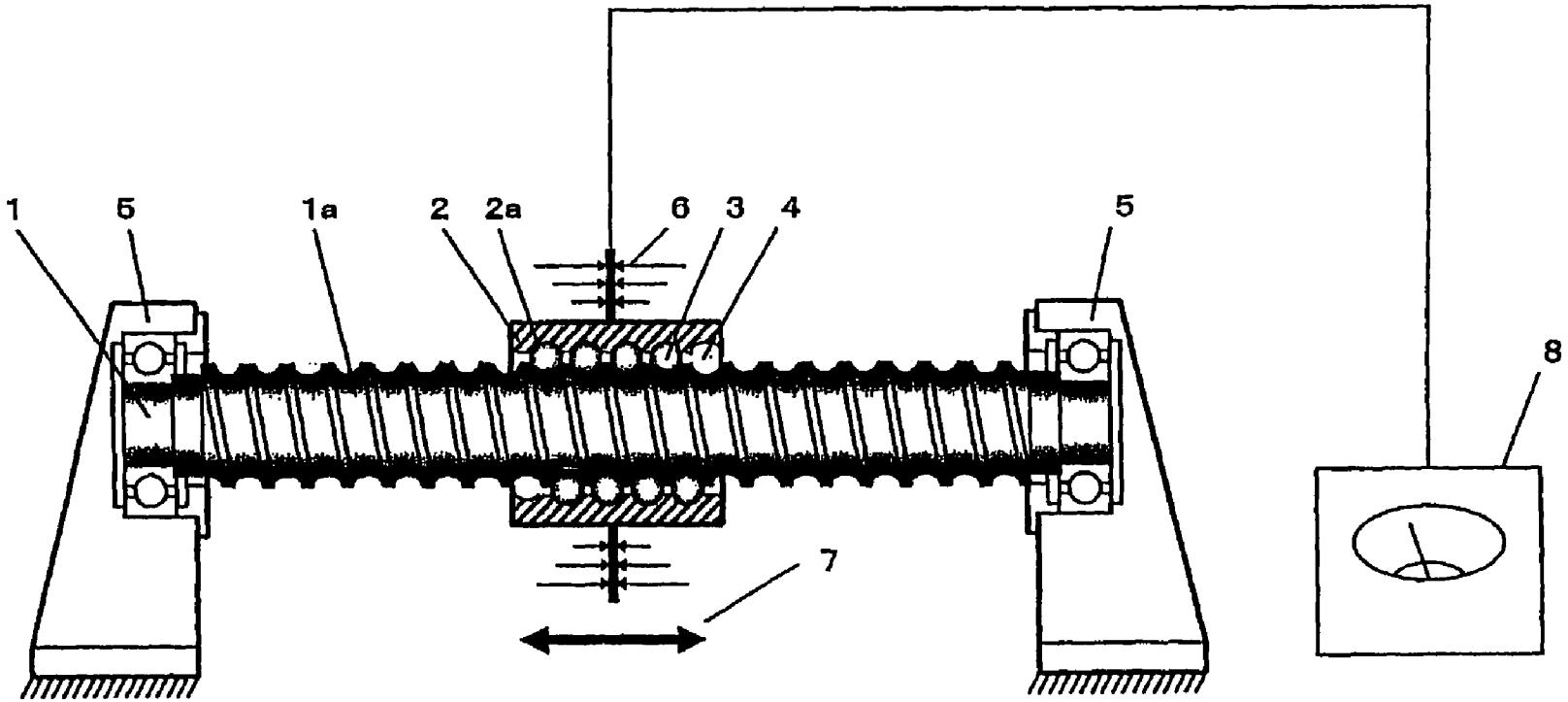
8
5
4
3
6
2a
2
1a
5
1
7

LUBRICATING GREASE COMPOSITION

CROSS-REFERENCE TO RELATED APPLICATIONS

This application claims the benefit of Japanese Patent Application No. 2005-131694, filed Apr. 28, 2005 which is incorporated herein by reference.

FIELD OF THE INVENTION

The present invention relates to a lubricating grease composition having improved friction properties and lubrication characteristics.

BACKGROUND OF THE INVENTION

Lubricating materials have been used in the sliding parts and rotating parts of the various kinds of industrial machines, not least in the automobile industry. Very many of these machines use grease lubrication in order to simplify the seal structure and enable the apparatus to be small and compact.

The range of use of grease lubrication is extremely wide, for example, in the various types of rolling bearings and sliding bearings which support a rotating body, in sliding screws or ball screws having a feed screw structure, linear guides having a translation structure, ball joints having a link structure, and also in various kinds of gears.

As the requisite quality of industrial machines has improved year by year, the performance required has also reached a high level, and there are now many machines which aim for differentiation by adding various specifications.

In particular, the technical innovation in automobile electric power steering devices is remarkable, such that these devices, which were initially only used in some solar cars and light automobiles, are now very widely installed in small to medium-sized passenger cars. This is a vigorously growing sector wherein the number of such devices installed is almost doubling every year.

In electric power steering devices an electric motor is used as the power assist power source. By means of a control unit, it is possible to drive the electric motor only at times when the power assist is necessary. Moreover, since the electric motor drive uses electricity generated when the car is running, the engine power loss is very small. Accordingly, there is a substantial fuel economy effect, and energy consumption is decreased greatly compared to hydraulic power steering devices.

However, since the power output generated by current electric power steering devices is still low compared to that from hydraulic power steering devices, it is important not only to increase the electric motor power but also to decrease the load on the motor to the maximum extent by reducing friction among individual component parts as much as possible.

The improvement in quality and features of the above-mentioned machines is of course often in elements that correspond to design, but the operating conditions at the sliding parts and behaviour such as friction fluctuations are largely related to the lubricants used. The lubricant characteristics are also very important in respect of smooth handling conditions or consistent movements, and also the feedback sensed by equipment operators.

For example, in the case of a car's steering apparatus, the sensations felt by the driver while handling it are very important. If it feels too light, the driver will feel unsafe. If it is too heavy, handling will be detrimentally affected and it will the give the driver an uncomfortable feeling of effort. Moreover, the feeling when operating the steering must not be the same when driving straight ahead and when manoeuvring. If handling while driving straight ahead is possible with tiny movements, the consistent and gentle sensation of steering will contribute to safe forward progression of the car and will give a feeling of a satisfying drive where the driver is safe. If steering in reverse, operation must also give a light and stable feeling.

Furthermore, in order to finish a workpiece accurately and with good precision on the XY table of a machine tool, stable operating characteristics are extremely important. If frictional phenomena such as fluctuations or breaks in the oil film occur, these may lead to a reduction in the quality of the workpiece, and the accuracy of the precision of the machining will be lost.

Apart from these cases, there are the sliding parts of cooling fan bearings in cars and the various gears and bearings of the steering apparatus unit, the bearings of rack guides, ball joints and air compressors. Since these car parts frequently undergo repeated stop-start operation, they may be said to be in a lubricating environment where friction fluctuations are likely to occur. Bucket pins of construction machines such as power shovels and bulldozers, or the sliding parts of turning gears and crane booms also undergo repeated stop-start operation and are also in a lubricating environment where friction fluctuations are likely to occur.

Furthermore, table rollers in, for example, steelmaking equipment repeat the operation of rotating as the steel material passes through and stopping once the steel material has gone through. In the case of journal bearings in a forging press, the crank actuates the eccentric shaft only when the material is being processed. Since the workpiece is also subjected to pressing processes, the bearings used here may be said to be in an environment where friction and torque fluctuations are likely to occur because they are subjected to conditions of repeated stop-starts.

The factors under which these irregular friction fluctuations occur are in an environment of 100% relative sliding in, for example, the sliding screws of machine tools, the suspension ball joints of automobiles and the journal bearings of forging presses, where no rotating body is present. When supply or intervention of a grease is insufficient or the prescribed lubricant film is not formed, friction fluctuations are generated. These friction fluctuations are particularly likely to occur in the process of shifting from the stop state to the operating state.

Even though gear apparatuses have a different structure, sliding friction also constantly occurs at the contact points between the gears. Consequently, if the supply or intervention of a grease is insufficient and the viscoelasticity of the intervening grease is insufficient or reduced, friction fluctuations are generated and wear also increases.

Further, in the various types of rolling bearings, ball screws or the like in which rotating bodies are interposed, the distances of the raceway surface on which the rotating bodies are interposed differ in internal and external diameters. Thus, sliding occurs between the rotating bodies such as balls or rollers interposed there and the actuating surface. Also, in mechanisms typically represented by ball screws with no retainers present where a plurality of balls is disposed, the balls thus interposed rotate and come into contact with each other, so that relative sliding occurs on their contact surfaces. Also, in the process of moving from normal rotation to reverse rotation, differences in the spacing between balls occur, so that time gaps arise before the balls settle and revert to the rotating state. Whenever the oil film or the viscoelasticity of the grease is insufficient, conditions are generated under which friction fluctuations such as stick-slip will be likely to occur.

Therefore, to enhance machine reliability and safety, it is extremely important to reduce the friction fluctuations in the sliding parts of such machinery and so switch over to a stable rolling and/or sliding state.

Hitherto there have been many patent documents contributing to enhancement of friction properties and lubrication characteristics. However, virtually none of the documents disclose techniques for preventing friction fluctuations.

Japanese Laid-open Patent Application 1985-31598 discloses a technique in which the operating torque of suspension ball joints, for example in cars, is reduced by application of a ball-joint grease composition in which a paraffin wax or a fatty acid amide wax and a urea thickener are blended in a poly-α-olefin type synthetic oil having a viscosity at 40° C. of 500 to 2000 cSt. However, whilst the urea compound and fatty acid amide wax disclosed in said document resemble aspects of the grease composition of the present invention, the grease described therein differs from the lubricating grease composition of the present invention in respect of the three compounds which are combined as the thickener constituent. Furthermore, said document is concerned only with torque reduction. In contrast, the present invention offers an effect in which sporadically generated irregular friction fluctuations are reduced in the sliding parts of machines and stable friction characteristics are imparted. Hence, the present invention is concerned with completely different problem from said document.

Japanese Laid-open Patent Application 1990-194095 discloses a technique in which a ball-joint grease composition containing a urea-type thickener and a specified dehydrogenated dewaxed base oil and paraffin wax or a fatty acid amide wax. Said grease composition is said to give rise to small operating torque in a ball joint in an automobile or the like and also has no detrimental effect on the protective-boot rubber. However, whilst the urea compound and fatty acid amide wax described in said document resemble the grease composition of the present invention, the thickener constituents of the present invention and the problem addressed by the present invention differ completely.

Japanese Laid-open Patent Application 1996-209167 discloses a grease composition for resin lubrication comprising a thickener, a base oil and 1 to 10 wt % of at least one fatty acid containing a hydroxyl group or fatty acid ester of a polyhydric alcohol, based on the total weight of said grease composition. The use of said grease composition results in a sufficient thickness of an oil film secured in lubrication between a metal and a resin. In addition, when said grease composition is applied to power transmission mechanisms such as power steering apparatus, the generation of torque fluctuations is suppressed even over long periods of use. However, the grease composition of JP 1996-209167 A is different to the grease composition of the present invention.

Japanese Laid-open Patent Application 2002-265970 discloses a grease composition which is said to have excellent acoustic performance and anti-fretting properties. Said grease composition is characterised in that the thickener is formed from a mixture of a urea compound and a lithium soap in a grease composition wherein the main constituents are a base oil and a thickener. Whilst the urea compound and the lithium soap described in said document resemble part of the grease composition of the present invention, fundamentally, the constituent components of their thickeners are different and the problem addressed by the present invention differs completely.

Japanese Laid-open Patent Application 2004-083797 discloses a technique for a grease composition containing a base oil and a thickener in which the grease composition is characterised in that the thickener is constituted by a polyurea and a metallic soap. Said grease composition has excellent acoustic properties at low torque, as well as generating less dust even at high temperatures and being highly effective in rotating apparatus. However, whilst the urea compound and the metallic soap disclosed in said document resemble part of the grease composition of the present invention, fundamentally, the constituent components of their thickeners are different and the effect of the present invention differs completely.

Japanese Laid-open Patent Application 2004-301268 discloses an electric power steering apparatus which transmits an auxiliary output from an electric motor to the steering mechanism of a vehicle via a reduction gear mechanism, where the driven gears of the aforementioned reduction gear mechanism are comprised, as a whole, of the outer circumference of a metallic core pipe, a resin part which is comprised of a resin composition of which the gear teeth are formed, where said reduction gear mechanism is lubricated by means of a grease composition. Said grease composition uses a thickener such as a diurea compound containing a wax into which a group having a polarity has been introduced into the molecular structure, and where the sliding lubrication between the resin members and metal members which are the sliding parts of said reduction gear mechanism is maintained favourably over a long period with excellent steering feel. However, in the case of the grease composition of the present invention and the grease composition of said patent document, only the diurea compound and a part of the additive constituents simply resemble part of the grease composition of the present invention. Fundamentally, the grease compositions of JP 2004-301268 A and the present Application are different and the effect and configuration of the present invention differs completely.

Japanese Laid-open Patent Application 2004-314916 discloses an electric power steering apparatus which transmits an auxiliary output from an electric motor to the steering mechanism of a vehicle via a reduction gear mechanism. With regard to the aforementioned driven gears, there is also disclosed a grease containing a urea compound as the thickener and a lithium soap as an additive which is interposed between said gears. Said gears comprised, as a whole, of the outer circumference of a metallic core pipe and a resin composition of which the gears are formed. However, whilst the diurea compound and the metallic soap contained as an additive in said grease resemble part of the lubricating grease composition of the present invention, fundamentally, the grease compositions are different and the effect and configuration of the present invention differs completely.

SUMMARY OF THE INVENTION

The present invention relates to a lubricating grease composition which uses a novel thickener capable of substantially reducing the irregular friction fluctuations which appear sporadically in the sliding rolling/sliding parts of machines, so that stable friction properties and lubrication characteristics are obtained.

BRIEF DESCRIPTION OF THE DRAWING

The FIGURE is a drawing showing the outlines of the measurement apparatus used in the friction fluctuation tests of the present invention.

DETAILED DESCRIPTION OF THE INVENTION

The elements of a lubricating grease composition, broadly divided, are comprised of three constituents: base oil, thickener and additives. In general, the roles of these three constituents are that the base oil carries out the main role of lubrication, the thickener hardens the liquid lubricating oil into a semi-solid, and the additives may be said to remedy any shortcomings in the capabilities of these grease base materials, for example, in corrosion or oxidation resistance.

However, it is not necessarily the case that the capabilities that these structural materials provide are appropriate or sufficient for all machines. If the structure and environment differ, the characteristics of the grease may change. Often the thickener may contribute considerably to lubrication and friction wear, the additives may have an effect on the thickener, and the base oil may be involved closely in stabilisation of the structure of the thickener.

Accordingly, in structural components where rolling/sliding wear occurs, irregular frictional fluctuations are likely to occur through differences in the lubricating grease composition.

In the present invention it has been surprisingly found that a novel thickener blend of three constituents substantially reduces the irregular friction fluctuations that occur sporadically in the rolling/sliding sliding parts of machines, and that hence it is possible to maintain stable friction characteristics and lubricating conditions.

Specifically, the present invention provides a lubricating grease composition comprising base oil and a blended thickener which comprises, as the thickener constituents, (a) one or more urea-type compounds; (b) one or more fatty acid metal salts; and (c) at least one type of amide compound selected from the group comprised of aliphatic amides and aliphatic bisamides shown by the general formulae (1) and (2):

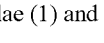

$$R_1CONH_2 \quad (1)$$

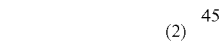

$$R_1CONHR_2NHCOR_1 \quad (2)$$

wherein $R_1$ denotes a saturated or unsaturated alkyl group having from 15 to 17 carbon atoms and $R_2$ denotes a methylene group or an ethylene group, and wherein the blending weight proportions of (a), (b) and (c) are in the ratio of a/(b+c) is in the range of from 0.20 to 10 wherein (1) constituent (a) has a blending weight ratio in the range of from 1 to 10;

(2) constituent (b) has a blending weight ratio in the range of from 0.5 to 2.5; and (3) constituent (c) has a blending weight ratio in the range of from 0.5 to 2.5.

The blended thickener is preferably present in an amount in the range of from 2 to 30 wt. %, based on the total weight of the lubricating grease composition.

Examples of the one or more urea-type compounds which may be used as constituent (a) in the present invention are, diurea, triurea and tetraurea compounds. Urea-urethane compounds may also be included.

The diurea compounds are reaction products of diisocyanates and monoamines which may be aliphatic amines, alicyclic amines and/or aromatic amines.

Examples of the monoamines that may be conveniently used include octylamine, decylamine, dodecylamine, tetradecylamine, hexadecylamine, octadecylamine, oleylamine, aniline, p-toluidine, cyclohexylamine.

Further, examples of diisocyanates that may be conveniently used include aliphatic diisocyanates, alicyclic diisocyanates and aromatic diisocyanates: for example, 4,4'-diphenylmethane diisocyanate (MDI), tolylene diisocyanate (TDI), phenyl diisocyanate, diphenyl diisocyanate, naphthalene diisocyanate, p-phenylene diisocyanate, trans-1,4-cyclohexane diisocyanate (CHDI), 1,3-bis-(isocyanatomethyl-benzene), 4,4'-dicyclohexylmethane diisocyanate (H12MDI), 1,3-bis-(isocyanatomethyl)-cyclohexane (H6XDI), hexamethylene diisocyanate (HDI), 3-isocyanatomethyl-3,3,5'-trimethylcyclohexylisocyanate (IPDI), phenylene diisocyanate, m-tetramethylxylene diisocyanate (m-TMXDI) and p-tetramethylxylene diisocyanate (p-TMXDI). In particular, 4-4'-diphenylmethane diisocyanate (MDI), tolylene diisocyanate (TDI), trans-1,4-cyclohexane diisocyanate (CHDI) and 4,4'-dicyclohexylmethane diisocyanate (H12MDI) are preferred.

The triurea compounds may be expressed by the general formula (3)

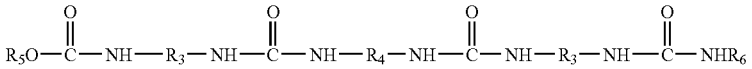

$$R_5O-\overset{\overset{\displaystyle O}{\|}}{C}-NH-R_3-NH-\overset{\overset{\displaystyle O}{\|}}{C}-NH-R_4-NH-\overset{\overset{\displaystyle O}{\|}}{C}-NH-R_3-NH-\overset{\overset{\displaystyle O}{\|}}{C}-NHR_6 \quad (3)$$

wherein $R_3$ and $R_4$ denote hydrocarbylene groups, and $R_5$ and $R_6$ denote hydrocarbyl groups.

These compounds are reaction products of 2 mol aliphatic, alicyclic or aromatic diisocyanate, 1 mol aliphatic, alicyclic or aromatic diamine, 1 mol aliphatic, alicyclic or aromatic amine and 1 mol aliphatic, alicyclic or aromatic alcohol. They are obtained by mixing the aforementioned compounds in base oil so as to give the respective aforementioned proportions, and effecting the reaction. For example, they may be obtained by reacting 2 mol tolylene diisocyanate, 1 mol ethylene diisocyanate, 1 mol octadecylamine and 1 mol octadecyl alcohol in a base oil.

Examples of the aliphatic, alicyclic or aromatic diisocyanates that may be conveniently used include 4,4'-diphenylmethane diisocyanate (MDI), tolylene diisocyanate (TDI), naphthalene diisocyanate, p-phenylene diisocyanate, trans-1,4-cyclohexane diisocyanate (CHDI), 1,3-bis-(isocyanatomethyl-benzene), 4,4'-dicyclohexylmethane diisocyanate (H12MDI), 1,3-bis-(isocyanatomethyl)-cyclohexane (H6XDI), hexamethylene diisocyanate (HDI), 3-isocyanatomethyl-3,3,5'-trimethylcyclohexylisocyanate (IPDI), phenylene diisocyanate, m-tetramethylxylene diisocyanate (m-TMXDI) and p-tetramethylxylene diisocyanate (p-TMXDI). In particular, 4-4'-diphenylmethane diisocyanate (MDI), tolylene diisocyanate (TDI), trans-1,4-cyclohexane diisocyanate (CHDI) and 4,4'-dicyclohexylmethane diisocyanate (H12MDI) are preferred.

Examples of monoamines that may be conveniently used include aliphatic, alicyclic and aromatic monoamines. Aliphatic monoamines are preferably saturated or unsaturated aliphatic amines with from 8 to 24 carbon atoms and may be used in branched or straight-chain forms, but straight-chain forms are particularly preferred.

Octylamine, decylamine, dodecylamine, tetradecylamine, hexadecylamine, octadecylamine, oleylamine, aniline, p-toluidine, cyclohexylamine are preferred.

Aliphatic, alicyclic or aromatic diamines, aliphatic diamines that may be conveniently used are ethylenediamine, trimethylenediamine, tetramethylenediamine, hexamethylenediamine, octamethylenediamine and decamethylenediamine, alicyclic diamines such as diaminocyclohexane, and aromatic diamines such as phenylenediamine, benzidine, diaminostilbene and tolidine, which are all diamines with from 2 to 12 carbon atoms therein.

Examples of monoalcohols that may be conveniently used are aliphatic, alicyclic or aromatic alcohols branched or straight-chain. Aliphatic alcohols, which are $C_8$ to $C_{24}$ saturated or unsaturated aliphatic alcohols may be conveniently used. Straight-chain forms are particularly preferred.

In particular octyl alcohol, decyl alcohol, dodecyl alcohol, tetradecyl alcohol, hexadecyl alcohol, octadecyl alcohol and oleyl alcohol are preferred.

An example of an alicyclic alcohol that may be conveniently used is cyclohexyl alcohol. Examples of aromatic alcohols that may be conveniently used include benzyl alcohol, salicyl alcohol, phenethyl alcohol, cinnamyl alcohol and hydrocinnamyl alcohol.

The tetraurea compounds may be expressed by the general formula (4):

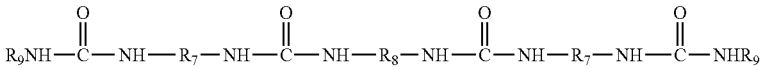

(4)

wherein $R_7$ and $R_8$ denote hydrocarbylene groups and $R_9$ denotes a hydrocarbyl group.

These compounds are reaction products of 2 mol aliphatic, alicyclic or aromatic diisocyanate, 1 mol aliphatic, alicyclic or aromatic diamine and 2 mol aliphatic, alicyclic or aromatic amine. They are obtained by mixing the aforementioned compounds in a normal base oil so as to give the respective aforementioned proportions, and effecting the reaction. For example, they may be obtained by reacting 2 mol tolylene diisocyanate, 1 mol ethylenediamine and 2 mol octadecylamine in base oil.

Examples of diisocyanates that may be conveniently used include aliphatic diisocyanates, alicyclic diisocyanates and aromatic diisocyanates: for example, 4,4'-diphenylmethane diisocyanate (MDI), tolylene diisocyanate (TDI), naphthalene diisocyanate, p-phenylene diisocyanate, trans-1,4-cyclohexane diisocyanate (CHDI), 1,3-bis-(isocyanatomethylbenzene), 4,4'-dicyclohexylmethane diisocyanate (H12MDI), 1,3-bis-(isocyanatomethyl)-cyclohexane (H6XDI), hexamethylene diisocyanate (HDI), 3-isocyanatomethyl-3,3,5'-trimethylcyclohexylisocyanate (IPDI), phenylene diisocyanate, m-tetramethylxylene diisocyanate (m-TMXDI) and p-tetramethylxylene diisocyanate (p-TMXDI). In particular, 4-4'-diphenylmethane diisocyanate (MDI), tolylene diisocyanate (TDI), trans-1,4-cyclohexane diisocyanate (CHDI) and 4,4'-dicyclohexylmethane diisocyanate (H12MDI) are preferred.

For the aliphatic, alicyclic or aromatic diamines, aliphatic diamines such as ethylenediamine, trimethylenediamine, tetramethylenediamine, hexamethylenediamine, octamethylenediamine and decamethylenediamine, alicyclic diamines such as diaminocyclohexane, and aromatic diamines such as phenylenediamine, benzidine, diaminostilbene and tolidine, which are all diamines with from 2 to 12 carbon atoms, may be conveniently used.

For the monoamines, aliphatic, alicyclic and aromatic monoamines may be conveniently used. Branched or straight-chain aliphatic monoamines which are saturated or unsaturated aliphatic amines with from 8 to 24 carbon atoms are preferred. Straight-chain saturated or unsaturated aliphatic amines with from 8 to 24 carbon atoms are particularly preferred.

As an example of an alicyclic monoamine, cyclohexylamine may be cited.

As examples of aromatic monoamines, aniline and p-toluidine may be cited.

However, any urea-type compounds disclosed in the prior art may be used. Particularly preferred urea-type compounds are those from wherein the urea-type compound comprises one or more straight chain hydrocarbon end groups. More preferably, in the range of from 10 to 70 mol % of the straight chain hydrocarbon end groups of the urea-type compound are unsaturated constituents.

The total amine value of the primary amines used to manufacture said one or more urea-type compounds is preferably in the range of from 200 to 500.

In a preferred embodiment of the present invention, the one or more urea-type compounds (a) are urea-type compounds having an average molecular weight in the range of from 500 to 1000.

Examples of fatty acid metal salts which may be conveniently used as constituent (b) in the present invention are metal salts of straight-chain saturated or unsaturated aliphatic monocarboxylic acids having in the range of from 6 to 24 carbon atoms (which may also contain a hydroxyl group) such as lauric acid, myristic acid, palmitic acid, stearic acid, 12-hydroxystearic acid, arachic acid, behenic acid, lignoceric acid, oleic acid, linolic acid, linolenic acid, and ricinoleic acid. Such metal salts preferably comprise metals selected from alkali metals, alkaline earth metals, zinc and aluminium. Said metals are more preferably selected from lithium, sodium, magnesium, aluminium, calcium, zinc and barium.

Particularly preferred fatty acid metal salts are metal salts of saturated or unsaturated aliphatic monocarboxylic acids having in the range of from 12 to 18 carbon atoms. Most preferably, said metal salts comprise lithium, magnesium, aluminium, calcium or zinc.

Amide compounds which may be conveniently used as constituent (c) in the present invention are compounds which may be obtained by reacting fatty acids and amines. Examples of such amide compounds include N,N'-ethylene bis-stearylamide, N,N'-methylene bis-stearylamide, stearylamide and oleylamide.

In a preferred embodiment of the present invention, the blending thickener consists of constituents (a), (b) and (c) as hereinbefore described. It is preferred that said constituents (a), (b) and (c) are present in the lubricating grease composition in a total amount in the range of from 2 to 30 wt. %, based on the total weight of the lubricating grease composition.

If the total amount of the aforementioned blended thickener is less than 2% by weight, than the effect of the thickener may be reduced, and the grease may become too soft and leak. If the total amount of the aforementioned blended thickener exceeds 30% by weight, then grease may become too hard, flow resistance may increase, the friction torque may rise and penetration properties may also decrease, so that sufficient lubricating effect may not be achieved.

In the present invention, the blending weight proportions of (a), (b) and (c) are in the ratio of a/(b+c) being in the range of from 0.20 to 10 wherein (1) constituent (a) has a blending weight ratio of 1 to 10;

(2) constituent (b) has a blending weight ratio of 0.5 to 2.5; and (3) constituent (c) has a blending weight ratio of 0.5 to 2.5.

If the ratio of a/(b+c) is less than 0.20 then the amount of urea component becomes too low and the heat resisting properties are insufficient. If the ratio of a/(b+c) exceeds 10, then insufficient reduction of friction fluctuations is achieved.

Also, if constituent (a) has a blending weight ratio of less than 1, this correlates with the relationship a/(b+c) and the amount of the urea component becomes too low and the heat resisting properties are insufficient. If constituents (b) and (c) respectively have blending weight ratios of less than 0.5, then insufficient reduction of the friction fluctuations is achieved. If constituents (b) and (c) respectively have blending weight ratios exceeding 2.5, then the amount of aliphatic metal salts and amide compound becomes too large, and whereas the effect of reducing the friction fluctuations is not improved in proportion, the friction torque increases. Furthermore in such circumstances, given that the urea component is reduced, the heat resisting properties may be insufficient.

The base oil in the present invention may be any base oil generally used for lubricating oils and greases. Said base oil may be one or more mineral oils, synthetic oils and natural oils.

Mineral oils that may be conveniently used are the refined residues lubricating oils obtained by vacuum distillation of atmospheric pressure residual oils obtained by vacuum distillation of atmospheric pressure residual oils obtained by atmospheric distillation of crude oil. Examples of said oils are paraffin oils, naphthene oils or normal paraffin. Example of mineral oils that may be used include those available from the Shell group under the trade designations "HVI", "MVIN" and "HMVIP".

Examples of synthetic oils that may be conveniently used include polyolefins such as α-olefin oligomers or polybutene, polyalkylene glycols such as polyethylene glycol or polypropylene glycol, diesters such as di-2-ethylhexyl sebacate or di-2-ethylhexyl adipate, polyesters such as trimethylolpropane ester or pentaerythritol ester, perfluoroalkyl ethers, silicone oils and polyphenyl ethers. Base oils of the type manufactured by the hydroisomerisation of wax, such as those sold by the Shell group under the trade designation "XHVI" may also be used.

Examples of natural oils that may be conveniently used include castor oil and vegetable oil.

The aforementioned base oils may be used singly or in mixtures.

The lubricating grease composition of the present invention may comprise one or more additives selected from anti-oxidants, corrosion inhibitors, oiliness agents (also known as friction modifiers), extreme-pressure additives, anti-wear agents, solid lubricants and metal deactivators or polymers.

Examples of anti-oxidants are 2,6-di-tertiary-butyl-4-methylphenol, 2,6-di-tertiary-butyl-para-cresol, P,P'-dioctyldiphenylamine, N-phenyl-α-naphthylamine and phenothiazine.

Examples of corrosion inhibitors are paraffin oxide, metal salts of carbonic acid, metal salts of sulphonic acid, carbonic acid esters, sulphonic acid esters, salicylic acid esters, succinic acid esters, sorbitan esters and various amine salts.

Examples of oiliness agents, extreme pressure additives and anti-wear agents are sulphurised zinc dialkyl dithiophosphate, sulphurised zinc diallyl dithiophosphate, sulphurised zinc dialkyl dithiocarbamate, sulphurised zinc diallyl dithiocarbamate, sulphurised molybdenum dialkyl dithiophosphate, sulphurised molybdenum diallyl dithiophosphate, sulphurised molybdenum dialkyl dithiocarbamate, sulphurised molybdenum diallyl dithiocarbamate, organic molybdenum complexes, olefin sulphide, triphenylphosphate, triphenylphosphorothionate, tricresylphosphate, and other phosphate esters and sulphurised oils and fats.

Examples of solid lubricants include molybdenum disulphide, graphite, boron nitride, melamine cyanurate, PTFE (polytetrafluoroethylene), tungsten disulphide and graphite fluoride.

Examples of metal deactivators are N,N'-disalicylidene-1,2-diaminopropane, benzotriazole, benzoimidazole, benzothiazole and thiadiazole. Examples of polymers are polybutene, polyisobutene, polyisobutylene, polyisoprene and polymethacrylate.

The present invention further provides a method of reducing friction fluctuations in the rolling and/or sliding parts of machines, wherein said method comprises lubricating said parts with a lubricating grease as hereinbefore described.

In addition, the present invention also provides an electric power steering device, characterised in that the lubricating grease composition as hereinbefore described is used therein as the lubricant.

Furthermore, the present invention also provides the use of a lubricating grease composition as hereinbefore described to lubricate an electric power steering apparatus.

By means of the present invention it is possible to offer a lubricating grease composition which uses a novel thickener blend, which lubricating grease composition is capable of substantially reducing the irregular friction fluctuations which appear sporadically in the sliding rolling/sliding parts of machines, so that stable friction properties and lubrication characteristics are obtained.

The present invention is described below with reference to the following Examples which are not intended to limit the scope of the present invention in anyway.

EXAMPLES

The isocyanates which were used in the manufacture of the urea compound (a) in Tables 1 and 2 were as follows:

"Isocyanate A" was tolulene diisocyanate. The 2,4-isomer and the 2,6-isomer were mixed in the proportions 80:20, respectively and the molecular weight was 174.16.

"Isocyanate B" was 4,4'-diphenylmethane diisocyanate. The molecular weight was 250.26.

The amines which were used in the manufacture of the urea compound (a) in Tables 1 and 2 were as follows:

"Amine A" was a straight-chain primary amine with an average molecular weight of 130 where the main constituent (at least 90%) was a saturated alkyl group with 8 carbon atoms (commercial caprylamine).

"Amine B" was a straight-chain primary amine with an average molecular weight of 270 where the main constituent (at least 90%) was a saturated alkyl group with 18 carbon atoms (commercial stearylamine).

"Amine C" was a straight-chain primary amine with an average molecular weight of 255 containing approximately 50% unsaturated alkyl groups with 18 carbon atoms and saturated or unsaturated alkyl groups with 14 to 18 carbon atoms (commercial tallow amine).

"Amine D" was a straight-chain primary amine with an average molecular weight of 260 where the main constituent (at least 70%) was an unsaturated alkyl group with 18 carbon atoms (commercial oleylamine).

"Amine E" was ethylenediamine.

"Alcohol A" in Tables 1 and 2, which was a raw material used to synthesise urethane, was stearyl alcohol.

As regards the fatty acid metal salt (b) in Tables 1 and 2:

"Fatty acid metal salt A" was a lithium salt of 12-hydroxystearic acid.

"Fatty acid metal salt B" was a lithium salt of stearic acid.

"Fatty acid metal salt C" was a calcium salt of stearic acid.

"Fatty acid metal salt D" was an aluminium salt of stearic acid.

"Fatty acid metal salt E" was a magnesium salt of stearic acid.

As regards the amide compound (c) in Tables 1 and 2:

"Amide A" was stearyl amide.

"Amide B" was N,N'-ethylene bis-stearylamide.

Also, the kinematic viscosity at 40° C. of the mineral oil used in the Examples and Comparative Examples of Tables 1 and 2 was 101.5 $mm^2/s$, and the pour point was −15° C. The kinematic viscosity of "Synthetic hydrocarbon oil A" in Tables 1 and 2 (CAS No. 68037-01-4) at 40° C. was 14.94 $mm^2/s$ and the pour point was −67.7° C. The kinematic viscosity of "Synthetic hydrocarbon oil B" in Tables 1 and 2 (CAS No. 68037-01-4) at 40° C. was 396.2 $mm^2/s$ and the pour point was −36° C.

Testing was carried out by the following procedures.

1. Penetration: JIS K2220
2. Dropping point: JIS K2220
3. Oil separation: JIS K2220 Method B, conditions 100° C., 24 hours.
4. Friction Fluctuation Tests The FIGURE is a drawing showing the outlines of the measurement apparatus used in the friction fluctuation tests of the present invention. Regarding the FIGURE and description, the following numbers and phrases are utilized:

1 Ballscrew
1*a* Ballscrew groove
2 Ballscrew nut
2*a* Nut groove
3 Ball
4 Helical path
5 Support bearing
6 Load cell
7 Direction of operation
8 Strain gauge Using the measuring apparatus shown in the FIGURE, the ballscrew nut 2 was made to move forward and back, and the friction forces generated during that time were input via the load cell 6 to the strain gauge 8 and recorded. By moving the ballscrew nut forward and back, the ball screw was rotated, and the frictional force for the steadily rotating state while that happened was taken as the steady frictional force. Frictional forces that exceeded 30% of the steady frictional force were regarded as frictional fluctuations, and counted by means of the strain gauge 8. The frequency with which fluctuating frictional forces were generated during the test was calculated as the frictional fluctuation generation rate.

The external diameter of the ballscrew 1 was 29 mm and the length of the screw part was approximately 225 mm. The balls 3 which formed the rotating bodies between the ballscrew 1 and ballscrew nut 2 were present in a plurality of arrays. The external diameter of these balls was 4.0 mm. These balls present in the plurality of arrays were of ordinary structure, returning to their original track via a helical path. The frictional forces detected were measured by detecting the frictional forces generated between balls and ball contact parts and/or balls and ballscrew rotating part and/or balls and ballscrew nut rotating part and/or balls and sliding part of the helical path.

5. SRV Friction Tests

The tests were carried out under the following conditions in accordance with ASTM D5707. The average friction coefficient and the depth of wear on the test plate after the test were measured, and the greases being tested were assessed.

Load: 700 N
Temperature: 50° C.
Duration: 60 minutes
Stroke amplitude: 500μ
Amplitude frequency: 15 Hz

TABLE 1

| | | Example | | | | | |
|---|---|---|---|---|---|---|---|
| | | 1 | 2 | 3 | 4 | 5 | 6 |
| Urea-type compound (a) | Isocyanate A (molar ratio) | 2.0 | 2.0 | — | — | — | — |
| | Isocyanate B (molar ratio) | | | 1.0 | 1.0 | 1.0 | 1.0 |
| | Amine A (molar ratio) | | | 1.0 | 0.75 | 1.0 | 0.75 |
| | Amine B (molar ratio) | | | 0.25 | 0.25 | — | — |
| | Amine C (molar ratio) | | 2.0 | — | 0.75 | 1.0 | — |
| | Amine D (molar ratio) | 1.0 | | 0.75 | 0.25 | — | 1.25 |
| | Amine E (molar ratio) | 1.0 | 1.0 | — | — | — | — |
| | Alcohol A (molar ratio) | 1.0 | | — | — | — | — |
| | Average molecular weight of the urea-type compound (a) (mol MW) | 939.6 | 924.3 | 642.5 | 673.0 | 635.0 | 676.3 |
| | Molecular weight ratio of unsaturated component in straight-chain hydrocarbon group of the urea-type compound (a) (mol %) | 33.5 | 43.9 | 35.3 | 27.2 | 29.7 | 56.9 |
| | Total amine value of amines making up raw material mgKOH/g | 465.8 | 292.2 | 289.1 | 265.7 | 291.6 | 264.6 |
| | Amount of urea-type compound (a) (a) (wt. %) | 7.0 | 5.0 | 5.0 | 5.0 | 8.0 | 11.0 |
| Fatty acid metal salt (b) | Fatty acid salt A (wt. %) | — | — | 4.5 | — | — | — |
| | Fatty acid salt B (wt. %) | 4.5 | — | — | 4.0 | — | — |
| | Fatty acid salt C (wt. %) | — | — | — | — | — | 1.0 |
| | Fatty acid salt D (wt. %) | — | — | — | — | 3.5 | — |
| | Fatty acid salt E (wt. %) | — | 3.5 | — | — | — | — |

TABLE 1-continued

| | | Example | | | | | |
|---|---|---|---|---|---|---|---|
| | | 1 | 2 | 3 | 4 | 5 | 6 |
| Amide compound (c) | Amide A (wt. %) | 2.5 | — | 3.5 | 2.0 | — | — |
| | Amide B (wt. %) | — | 3.5 | — | — | 3.5 | 1.0 |
| | Total amount of constituents (b) + (c) (wt. %) | 7.0 | 7.0 | 8.0 | 6.0 | 7.0 | 2.0 |
| | Blending weight ratio of constituent (a) in calculating formula a/(b + c) | 3.11 | 2.0 | 1.43 | 2.5 | 5.71 | 7.5 |
| | Blending weight ratio of constituent (b) in calculating formula a/(b + c) | 2.0 | 1.4 | 1.29 | 2.0 | 2.5 | 0.68 |
| | Blending weight ratio of constituent (c) in calculating formula a/(b + c) | 1.11 | 1.4 | 1.0 | 1.0 | 2.5 | 0.68 |
| | Blending weight proportion a/(b + c) | 1.00 | 0.71 | 0.63 | 0.83 | 1.14 | 5.50 |
| | Total thickener content (a + b + c) (wt. %) | 14.0 | 12.0 | 13.0 | 11.0 | 15.0 | 13.0 |
| | Mineral oil (wt. %) | 43.0 | 88.0 | 10.0 | 6.0 | — | — |
| | Synthetic hydrocarbon oil A (wt. %) | 43.0 | — | 77.0 | 77.0 | 78.0 | 87.0 |
| | Synthetic hydrocarbon oil B (wt. %) | — | — | — | 6.0 | 7.0 | — |
| | Total (wt. %) | 100.0 | 100.0 | 100.0 | 100.0 | 100.0 | 100.0 |

TABLE 2

| | | Comparative Example | | | | |
|---|---|---|---|---|---|---|
| | | 1 | 2 | 3 | 4 | 5 |
| Urea-type compound (a) | Isocyanate A (molar ratio) | | | | | Commercial lithium-type synthetic oil grease |
| | Isocyanate B (molar ratio) | 1.0 | 1.0 | 1.0 | 1.0 | |
| | Amine A (molar ratio) | 0.75 | 0.75 | 0.75 | 0.25 | |
| | Amine B (molar ratio) | 0.25 | 0.25 | 0.25 | — | |
| | Amine C (molar ratio) | 0.75 | 0.75 | 0.75 | — | |
| | Amine D (molar ratio) | 0.25 | 0.25 | 0.25 | 1.75 | |
| | Amine E (molar ratio) | — | — | — | — | |
| | Alcohol A (molar ratio) | — | — | — | — | |
| | Average molecular weight of the urea-type compound (a) (mol MW) | 673.0 | 673.0 | 673.0 | 743.7 | |
| | Molecular weight ratio of unsaturated component in straight-chain hydrocarbon group of the urea-type compound (a) (mol %) | 27.2 | 27.2 | 27.2 | 69.4 | |
| | Total amine value of amines making up raw material mgKOH/g | 265.7 | 265.7 | 265.7 | 228.8 | |
| | Amount of urea-type compound (a) (a) (wt. %) | 7.0 | 6.5 | 9.0 | 8.0 | |
| Fatty acid metal salt (b) | Fatty acid salt A (wt. %) | — | — | 0.25 | — | |
| | Fatty acid salt B (wt. %) | 6.0 | — | — | — | |
| | Fatty acid salt C (wt. %) | — | — | — | 0.50 | |
| | Fatty acid salt D (wt. %) | — | — | — | — | |
| | Fatty acid salt E (wt. %) | — | — | — | — | |
| Amide compound (c) | Amide A (wt. %) | — | — | 0.25 | — | |
| | Amide B (wt. %) | — | 6.0 | — | — | |
| | Total amount of constituents (b) + (c) (wt. %) | 6.0 | 6.0 | 0.5 | 0.5 | Commercial lithium-type synthetic oil grease |
| | Blending weight ratio of constituent (a) in calculating formula a/(b + c) | 1.0 | 1.0 | 10 | 8.0 | |
| | Blending weight ratio of constituent (b) in calculating formula a/(b + c) | 0.85 | 0 | 0.28 | 0.5 | |
| | Blending weight ratio of constituent (c) in calculating formula a/(b + c) | 0 | 0.92 | 0.28 | 0 | |
| | Blending weight proportion a/(b + c) | 1.17 | 1.08 | 18.0 | 16 | |
| | Total thickener content (a + b + c) (wt. %) | 13.0 | 12.5 | 9.5 | 8.5 | |
| | Mineral oil (wt. %) | — | — | — | — | |
| | Synthetic hydrocarbon oil A (wt. %) | 87.0 | 87.5 | 90.5 | — | |
| | Synthetic hydrocarbon oil B (wt. %) | — | — | — | 91.5 | |
| | Total (wt. %) | 100.0 | 100.0 | 100.0 | 100.0 | |

Examples 1 to 6

Using the blend proportions shown in Table 1, the base oil and each isocyanate were put into an airtight grease test apparatus, and heated to 60° C. while agitating. Raw material in which the various amines or stearyl alcohol had been mixed and dissolved in base oil was added from a hopper and a reaction effected. While agitating further, the reaction was brought to completion after heating up to 170° C. had been maintained for 30 minutes. The mixture was then quickly cooled, and during this cooling process a fatty acid metal salt and amide compound were blended in with agitation in the proportions shown in Table 1, cooling down to 80° C.

1.0 wt. % octyldiphenylamine was added extraproportionally as an anti-oxidant, and after leaving to cool to approximately 60° C., the grease was obtained by treating with a homogeniser. In the case of the greases of Examples 3 to 6, 1.5 wt. % organic molybdenum complex, 1.0 wt. % primary Zn dithiophosphate and 1.0 wt. % Zn dithiocarbamate were each also added extraproportionally as further additives, to create the greases to be tested.

The greases of Examples 1-6 were tested and the results thereof are shown in Table 3.

TABLE 3

| | Example | | | | | |
|---|---|---|---|---|---|---|
| | 1 | 2 | 3 | 4 | 5 | 6 |
| 1. Penetration | 291 | 258 | 305 | 320 | 297 | 258 |
| 2. Dropping point (° C.) | 235 | 264 | 217 | 214 | 235 | 231 |
| 3. Oil separation (mass %) | 0.45 | 0.12 | 0.32 | 0.34 | 0.30 | 0.28 |
| Kinematic viscosity of base oil 40° C. ($mm^2/s$) | 19.08 | 25.0 | 15.77 | 18.94 | 19.17 | 14.94 |
| 4. Friction fluctuation tests | | | | | | |
| Steady frictional force (lb) | 13.9 | 14.5 | 17.1 | 14.5 | 14.8 | 15.1 |
| Ratio of friction fluctuations generated (%) | 6.3 | 7.3 | 5.8 | 7.2 | 6.8 | 10.9 |
| 5. SRV friction test (700N, 15 Hz, 50° C., 60 min.) | | | | | | |
| Friction coefficient | — | — | — | 0.077 | 0.085 | 0.081 |
| Depth of wear on plate Rmax (μm) | — | — | — | 0.91 | 0.88 | 0.91 |

Comparative Examples 1 to 4

Using the blend proportions shown in Table 2, the base oil and each isocyanate were put into an airtight grease test apparatus, and heated to 60° C. while agitating. Raw material in which the various amines had been mixed and dissolved in base oil was added from a hopper and a reaction effected. While agitating further, the reaction was brought to completion after heating up to 170° C. had been maintained for 30 minutes. The mixture was then quickly cooled, and during this cooling process a fatty acid metal salt and/or amide compound was/were blended in with agitation in the proportions shown in Table 2, cooling down to 80° C.

1.0% octyldiphenylamine was added extraproportionally as an anti-oxidant, and after leaving to cool to approximately 60° C., the grease was obtained by treating with a homogeniser.

In the case of the greases of Comparative Examples 1 to 4, 1.5 wt. % organic molybdenum complex, 1.0 wt. % primary Zn dithiophosphate and 1.0 wt. % Zn dithiocarbamate were each also added extraproportionally as further additives, to create the greases to be tested.

Comparative Example 5

Comparative Example 5 as shown in Table 2 was a commercial lithium-type synthetic grease.

The greases of Comparative Examples 1 to 5 were tested and the results thereof are shown in Table 4.

TABLE 4

| | Comparative Example | | | | |
|---|---|---|---|---|---|
| | 1 | 2 | 3 | 4 | 5 |
| 1. Penetration | 278 | 280 | 275 | 277 | 256 |
| 2. Dropping point (° C.) | 230 | 228 | 232 | 218 | 191 |
| 3. Oil separation (mass %) | 0.32 | 0.32 | 0.28 | 0.26 | 0.34 |
| Kinematic viscosity of base oil 40° C. $mm^2/s$ | 14.94 | 14.94 | 14.94 | 396.2 | 26.4 |
| 4. Friction fluctuation tests | | | | | |
| Steady frictional force (lb) | 15.4 | 20.3 | 12.4 | 11.9 | 24.3 |
| Ratio of friction fluctuations generated (%) | 11.8 | 10.7 | 37.4 | 40.1 | 47.7 |

TABLE 4-continued

| | Comparative Example | | | | |
|---|---|---|---|---|---|
| | 1 | 2 | 3 | 4 | 5 |
| 5. SRV friction test (700N, 15 Hz, 50° C., 60 min.) | | | | | |
| Friction coefficient* | Welded at 12 min | 1.12 | — | — | Welded at 5 min |
| Depth of wear on plate Rmax (μm) | 2.67 | 0.95 | — | — | 3.21 |

*Friction coefficients above 0.2 are reported as "welded".

The following benefits can be seen from the results of Tables 3 and 4:

(i) The lubricating grease composition of the present invention substantially reduced the irregular friction fluctuations generated on the rolling-sliding surfaces, and displayed low and stable friction characteristics.

(ii) The lubricating grease composition of the present invention also had a low and stable friction coefficient in typical friction and wear tests such as SRV, and displayed excellent lubricating properties with no rise in abnormal friction such as oil-film breaks and with small wear.

What is claimed is:

1. A lubricating grease composition comprising base oil and a blended thickener which comprises, as the thickener constituents, (a) one or more urea-type compounds;

(b) one or more fatty acid metal salts; and (c) at least one type of amide compound selected from the group comprised of aliphatic amides and aliphatic bisamides shown by the general formulae (1) and (2):

$$R_1CONH_2 \quad (1)$$

$$R_1CONHR_2NHCOR_1 \quad (2)$$

wherein $R_1$ denotes a saturated or unsaturated alkyl group having from 15 to 17 carbon atoms and $R_2$ denotes a methylene group or an ethylene group, and wherein the blending weight proportions of (a), (b) and (c) are in the ratio of a/(b+c) is in the range of from 0.20 to 10 wherein (1) constituent (a) has a blending weight ratio in the range of from of 1 to 10;

(2) constituent (b) has a blending weight ratio in the range of from 0.5 to 2.5; and (3) constituent (c) has a blending weight ratio in the range of from 0.5 to 2.5.

2. The lubricating grease composition of claim 1 wherein the blended thickener is present in an amount in the range of from 2 to 30 wt. % based on the total weight of the lubricating grease composition.

3. The lubricating grease composition of claim 1 wherein the one or more urea-type compounds (a) are urea-type compounds having an average molecular weight in the range of from 500 to 1000.

4. The lubricating grease composition of claim 1 wherein the urea-type compound comprises one or more straight chain hydrocarbon end groups wherein in the range of from 10 to 70 mol % of the straight chain hydrocarbon end groups are unsaturated constituents.

5. The lubricating grease composition of claim 1 wherein the total amine value of the primary amines used to manufacture said one or more urea-type compounds (a) is preferably in the range of from 200 to 500.

6. The lubricating grease composition of claim 1 wherein the one or more fatty acid metal salts are metal salts of straight chain saturated or unsaturated aliphatic monocarboxylic acids having in the range of from 6 to 24 carbon atoms.

7. The lubricating grease composition of claim 1 wherein the one or more fatty acid metal salts comprise metals selected from alkali metals, alkaline earth metals, zinc and aluminium.

8. The lubricating grease composition of claim 1 wherein said lubricating grease composition comprises one or more additives selected from anti-oxidants, corrosion inhibitors, friction modifiers, extreme-pressure additives, anti-wear agents, solid lubricants and metal deactivators or polymers.

9. A method of reducing friction fluctuations in the rolling and/or sliding parts of machines wherein said method comprises lubricating said parts with the lubricating grease composition of claim 1.

10. A process of using the lubricating grease composition of claim 1 to lubricate an electric power steering apparatus comprising lubricating the electric power steering apparatus.

11. The lubricating grease composition of claim 2 wherein the one or more urea-type compounds (a) are urea-type compounds having an average molecular weight in the range of from 500 to 1000.

12. The lubricating grease composition of claim 2 wherein the urea-type compound comprises one or more straight chain hydrocarbon end groups wherein in the range of from 10 to 70 mol % of the straight chain hydrocarbon end groups are unsaturated constituents.

13. The lubricating grease composition of claim 3 wherein the urea-type compound comprises one or more straight chain hydrocarbon end groups wherein in the range of from 10 to 70 mol % of the straight chain hydrocarbon end groups are unsaturated constituents.

14. The lubricating grease composition of claim 2 wherein the total amine value of the primary amines used to manufacture said one or more urea-type compounds (a) is preferably in the range of from 200 to 500.

15. The lubricating grease composition of claim 3 wherein the total amine value of the primary amines used to manufacture said one or more urea-type compounds (a) is preferably in the range of from 200 to 500.

16. The lubricating grease composition of claim 4 wherein the total amine value of the primary amines used to manufacture said one or more urea-type compounds (a) is preferably in the range of from 200 to 500.

17. The lubricating grease composition of claim 2 wherein the one or more fatty acid metal salts are metal salts of straight chain saturated or unsaturated aliphatic monocarboxylic acids having in the range of from 6 to 24 carbon atoms.

18. The lubricating grease composition of claim 3 wherein the one or more fatty acid metal salts are metal salts of straight chain saturated or unsaturated aliphatic monocarboxylic acids having in the range of from 6 to 24 carbon atoms.

19. The lubricating grease composition of claim 4 wherein the one or more fatty acid metal salts are metal salts of straight chain saturated or unsaturated aliphatic monocarboxylic acids having in the range of from 6 to 24 carbon atoms.

20. The lubricating grease composition of claim 5 wherein the one or more fatty acid metal salts are metal salts of straight chain saturated or unsaturated aliphatic monocarboxylic acids having in the range of from 6 to 24 carbon atoms.

* * * * *